US007261601B1

(12) United States Patent
Chen

(10) Patent No.: US 7,261,601 B1
(45) Date of Patent: Aug. 28, 2007

(54) ELECTRICAL CONNECTOR ASSEMBLY

(75) Inventor: Ming Ching Chen, Tu-Cheng (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 11/656,086

(22) Filed: Jan. 22, 2007

(30) Foreign Application Priority Data

Jan. 20, 2006 (TW) ..... 95102308

(51) Int. Cl.
*H01R 24/00* (2006.01)

(52) U.S. Cl. ..... 439/660

(58) Field of Classification Search ..... 439/660, 439/74, 73, 66

See application file for complete search history.

(56) References Cited

U.S. PATENT DOCUMENTS 5,975,916 A * 11/1999 Okura ..... 439/74
6,764,314 B1 * 7/2004 Lee ..... 439/65
6,811,411 B1 * 11/2004 Hirata et al. ..... 439/74

FOREIGN PATENT DOCUMENTS

JP 2003-323925 11/2003

* cited by examiner

*Primary Examiner*—Phuong Dinh
(74) *Attorney, Agent, or Firm*—Wei Te Chung

(57) ABSTRACT

An electrical connector assembly comprises a receptacle connector having a receptacle housing and a plurality of receptacle contacts, and a plug connector engaging with the receptacle connector. Said receptacle housing defines a space and a plurality of alternate channels and slots in two lateral sidewalls beside the space. Said receptacle contacts each has a retaining portion and a first elastic portion with a first contacting portion, which are both transversely extending and respectively disposed in the slot and the channel of the receptacle housing, with the first contacting portion exposed in the space. The plug connector inserts into the space of the receptacle connector and electrically contacts with the receptacle contacts.

3 Claims, 8 Drawing Sheets

ELECTRICAL CONNECTOR ASSEMBLY

BACKGROUND OF THE INVENTION

1. Field of the Invention

The present invention is generally related to an electrical connector assembly for connecting two printed circuit boards.

2. Description of Related Art

It is well known that a board-to-board connector assembly is widely used for connecting two printed circuit boards (PCBs) together and includes a plug connector mounted on a PCB and a receptacle connector mounted on another PCB and electrically connected with the plug connector.

U.S. Pat. No. 5,975,916 discloses a connector assembly including a plug connector and a receptacle connector, the plug connector has an elongated first housing and a plurality of first contacts assembled to the first housing, a receptacle connector has a second housing with a space for receiving the plug connector and a plurality of second contacts fixed in the second housing. Each of the first contact and the second contact is formed with a soldering portion for being soldered to corresponding printed circuit boards, a retaining portion and a contacting portion. The retaining portion of the second contact is in an inverse U-shape completely abutting the second housing. However, the insertion direction of the retaining portions is same as the insertion of the plug connector into the receptacle connector, so when the plug connector is pulled out from the receptacle connector, the retaining portions of the second contacts may also be pulled along the same direction, and that will lead to unreliable retaining of second contacts and affect the engaging between the second contacts and the first contacts. And once the retaining portions are not retained, the soldering portions will also be pulled from the print circuit board. Otherwise, the contacting portion transversely extends for a certain distance from an end of the U-shaped retaining portion and then upwardly, since the U-shaped retaining portion occupy a certain transverse space, a transverse dimension of the connecting porting is limited and may not has enough elasticity.

Japanese Patent Unexamined Publication. No 2003-323925 discloses another connector assembly including a plug connector and a receptacle connector. The receptacle connector has female contacts, each having a vertical portion, an M-shaped extending portion transversely extending from the vertical portion with a contacting portion in an end and a retaining portion extending from the vertical portion. However, since the retaining portion is upon the extending portion, that will increases a height of the female contact and the receptacle connector.

Hence, am improved connector is required to overcome the disadvantages of the related art.

SUMMARY OF THE INVENTION

Accordingly, an object of the present invention is to provide a connector having reliably retained contacts therein and a lower configuration.

To achieve the above object, an connector assembly comprising a longitudinal receptacle connector having a receptacle housing and a plurality of receptacle contacts, and a plug connector having a plug housing and a plurality of plug contacts for electrical contacting with the receptacle contacts. The receptacle housing defines a space and two lateral sidewalls with a plurality of slots and retaining channels, each receptacle contact comprises a retaining portion, an first elastic portion with a first contacting portion and a mounting portion, the retaining portions and the elastic portions respectively inserting into corresponding slots and retaining channels, the contacting portions exposed in the space. The plug connector is capable to insert into the space of the receptacle connector and electrically contacts with the receptacle connector.

Other objects, advantages and novel features of the present invention will be drawn from the following detailed description of a preferred embodiment of the present invention with attached drawings:

DETAILED DESCRIPTION OF THE INVENTION

Reference will now be made in detail to the preferred embodiment of the present invention.

Figure 1:
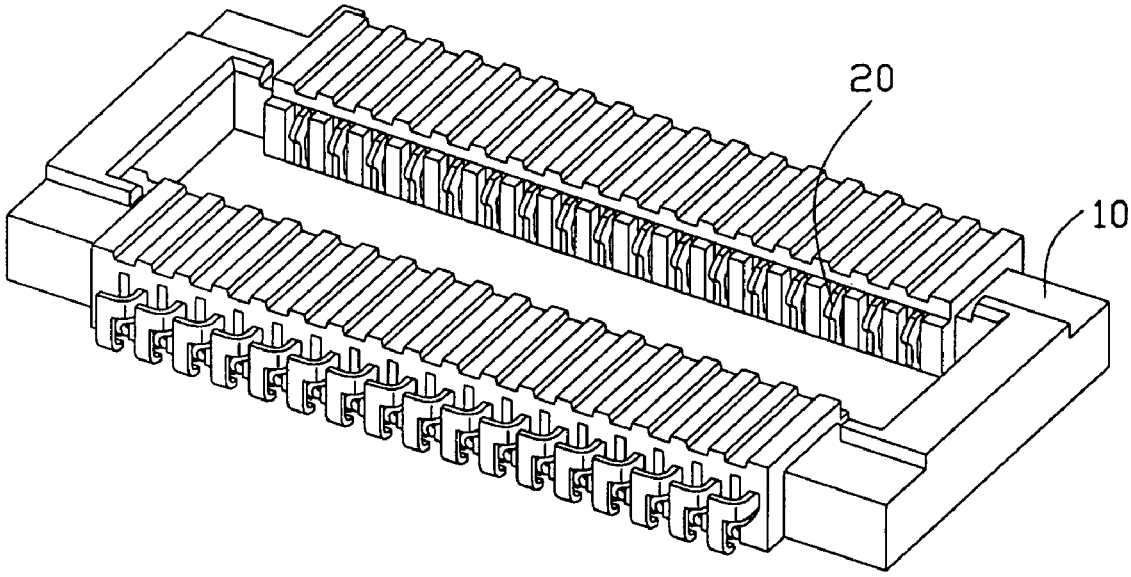
FIG. 1 is an assembled, perspective view of receptacle connector of a connector assembly in accordance with the present invention.
Figure 2:
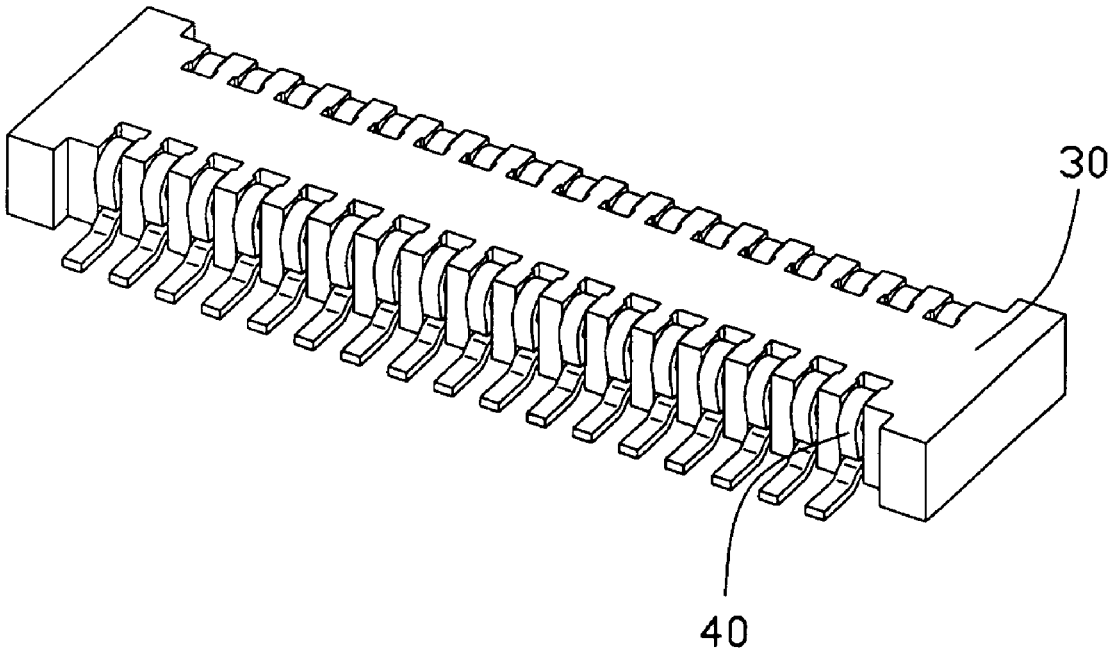
FIG. 2 is an assembled, perspective view of plug connector of a connector assembly in accordance with the present invention.

Referring to FIGS. 1-2, the connector assembly in accordance with the present invention comprises a receptacle connector 10 and a plug connector 30 engaging with the receptacle connector 10.

Figure 3:
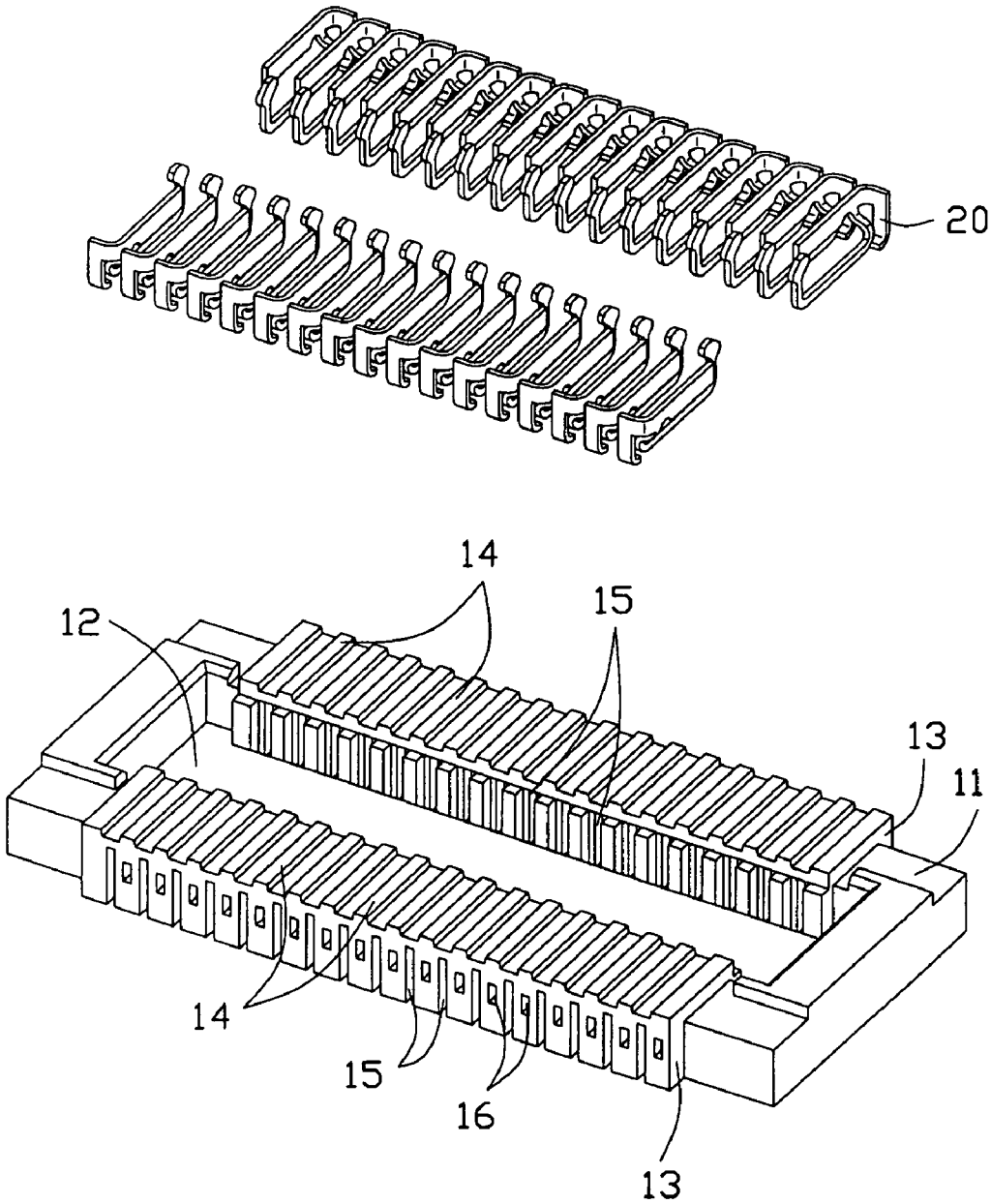
FIG. 3 is an exploded, perspective view of the receptacle connector in FIG. 1.
Figure 4:
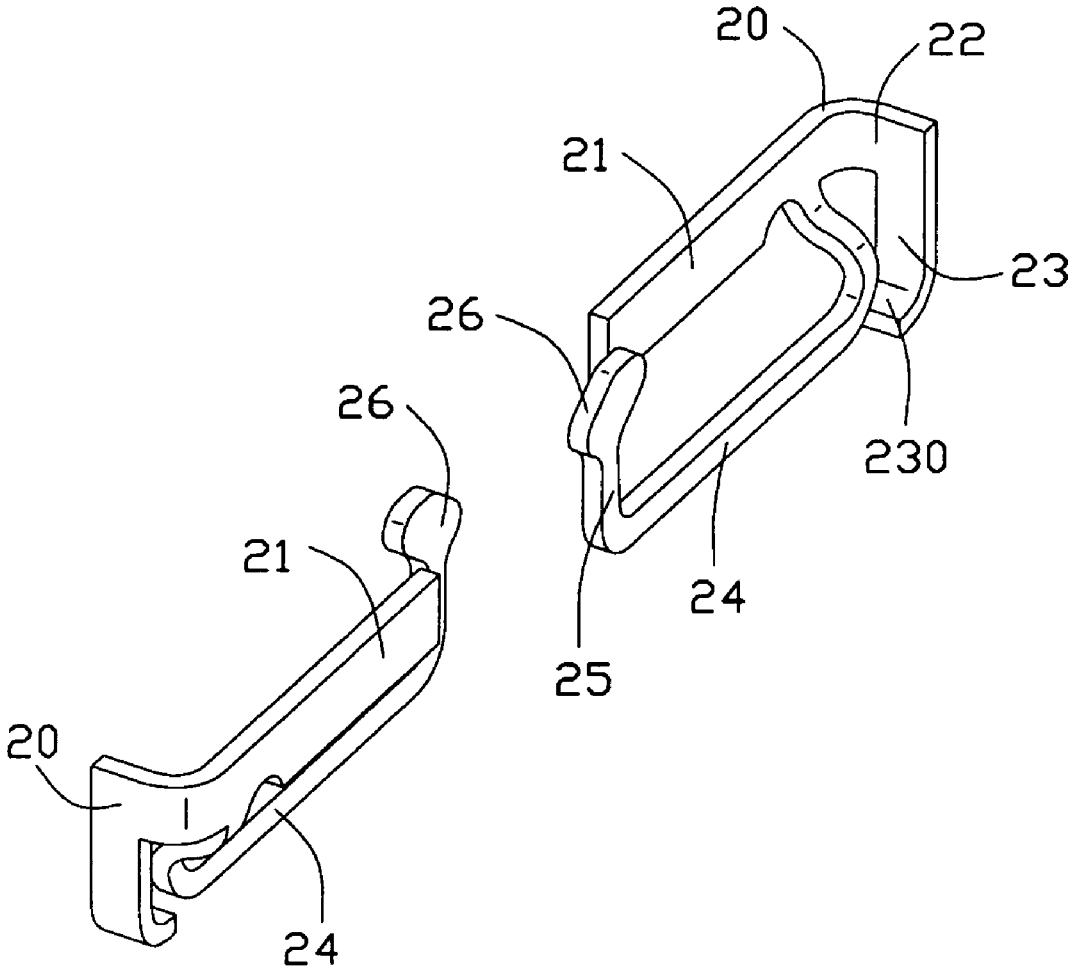
FIG. 4 is perspective view of receptacle contacts of the receptacle connector.

Referring to FIG. 3 and FIG. 4, the receptacle connector 10 defines a longitudinal direction in length, and a transverse direction in width. The receptacle connector 10 has an elongated receptacle housing 11 and a plurality of receptacle contacts 20 received in the receptacle housing 11. The receptacle housing 11 is formed with a space 12 recessed from a center thereof for an insertion of the plug connector 30 and a plurality of sidewalls surrounding the space 12 and comprising two lateral sidewalls 13 and two end sidewalls (not labeled) linking the two lateral sidewalls 13. Each lateral sidewall 13 is formed with a plurality of parallel ribs 14 on a top surface thereof and defines a plurality of slots 15 and retaining channels 16 recessed from out side surfaces thereof and extending transversely toward the space 12 in the center of the receptacle housing 11. The slots 15 run transversely through inner side surfaces of the two lateral sidewalls 13 to communicate with the space 12 and downwardly through bottom surfaces of the lateral sidewalls 13, the retaining channels 16 only pass through the out side surfaces of the receptacle housing 11 for fixing the receptacle contacts 20.

The receptacle contact 20 is stamped from metal piece and comprises a retaining portion 21 extending in transverse direction, a linking portion 22 horizontally bent from an end of the retaining portion 21, a mounting portion 23 extending downwardly from an end of the linking portion 22 away from the retaining portion 21 and a first U-shaped elastic portion 24 extending from a bottom edge of the retaining portion 22 near the linking portion 22. The retaining portion 21 and the first elastic portion 24 of each receptacle contact are both extending transversely and away from the linking portion 22. The retaining portion 21 and the first elastic portion 24 are in same side of the linking portion 22, but in different transverse surfaces. The mounting portion 23 has a tail bent inwardly from an end thereof to being soldered to a print circuit board. A leg of the U-shaped first elastic portion 24 with a free end is defined as an elastic arm 25, the elastic arm 25 has a contacting portion 26 with a protruding portion (not labeled) for electrically connecting with plug contacts 40 of the plug connector 30.

Figure 6:
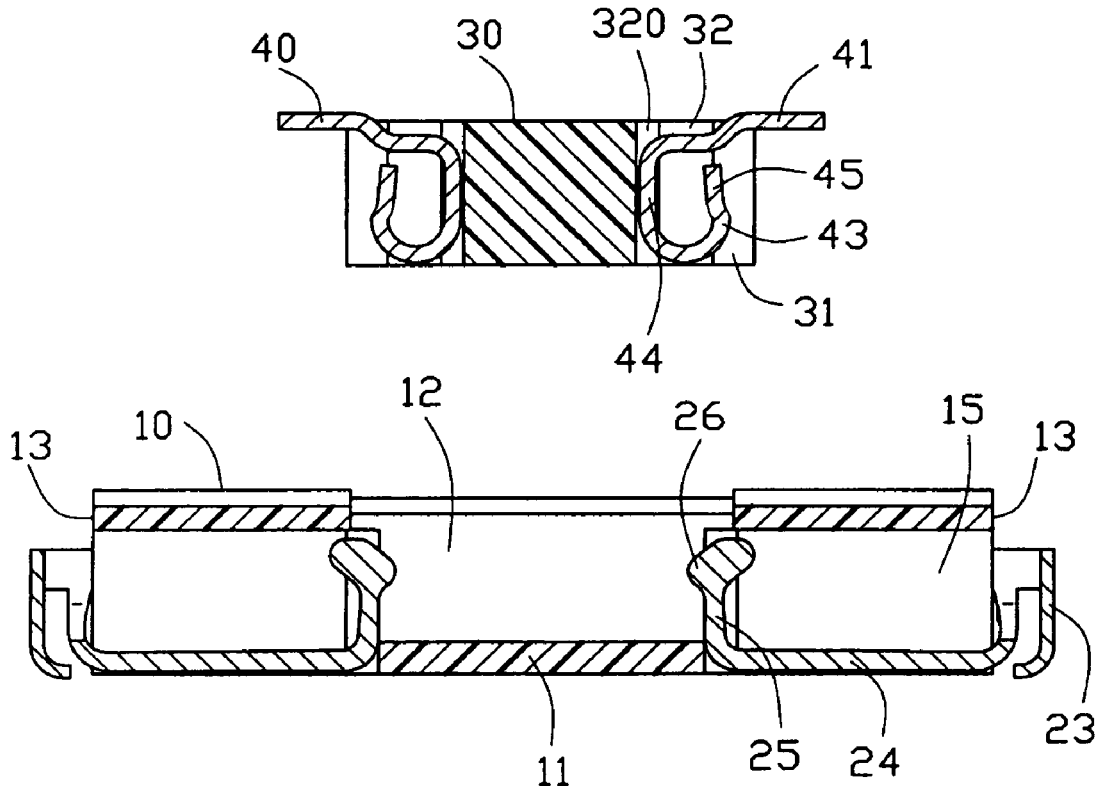
FIG. 6 is a section view of the connector assembly in accordance with the present invention before the plug connector inserts into the receptacle connector.
Figure 7:
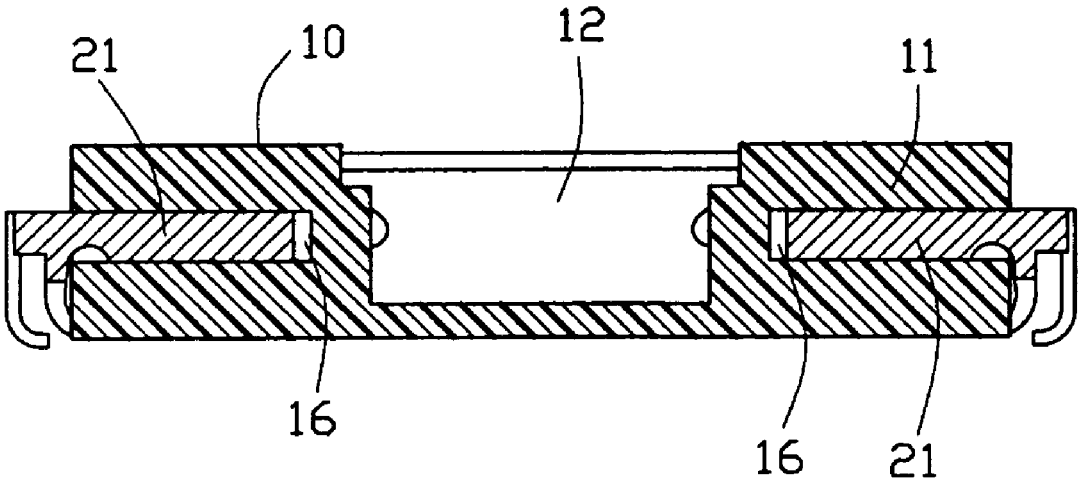
FIG. 7 is another section view of the receptacle connector of the connector assembly.

Referring to FIG. 6 and FIG. 7, FIG. 6 shows a section view of the receptacle connector 10 taken from a line along an extending direction of the first elastic portion 24, FIG. 6 shows a section view of the receptacle connector 10 taken from a line along an extending direction of the retaining portion 21. Conjoining with FIG. 1 and FIG. 3, the receptacle contacts 20 respectively insert into the receptacle housing 11 from two lateral sides of the receptacle housing 11. The retaining portion 21 and the first elastic portion 24 of each receptacle contact 20 respectively insert into the retaining channels 16 and an adjacent slots 15, the contacting portion 26 of the first elastic 24 passes through the slot 166 and is exposed in the space 12. Another end of the first elastic 24 opposed to the contacting portion 16 is outside of the receptacle housing 11, and the mounting portion 23 is soldered to the print circuit board (not shown).

Figure 5:
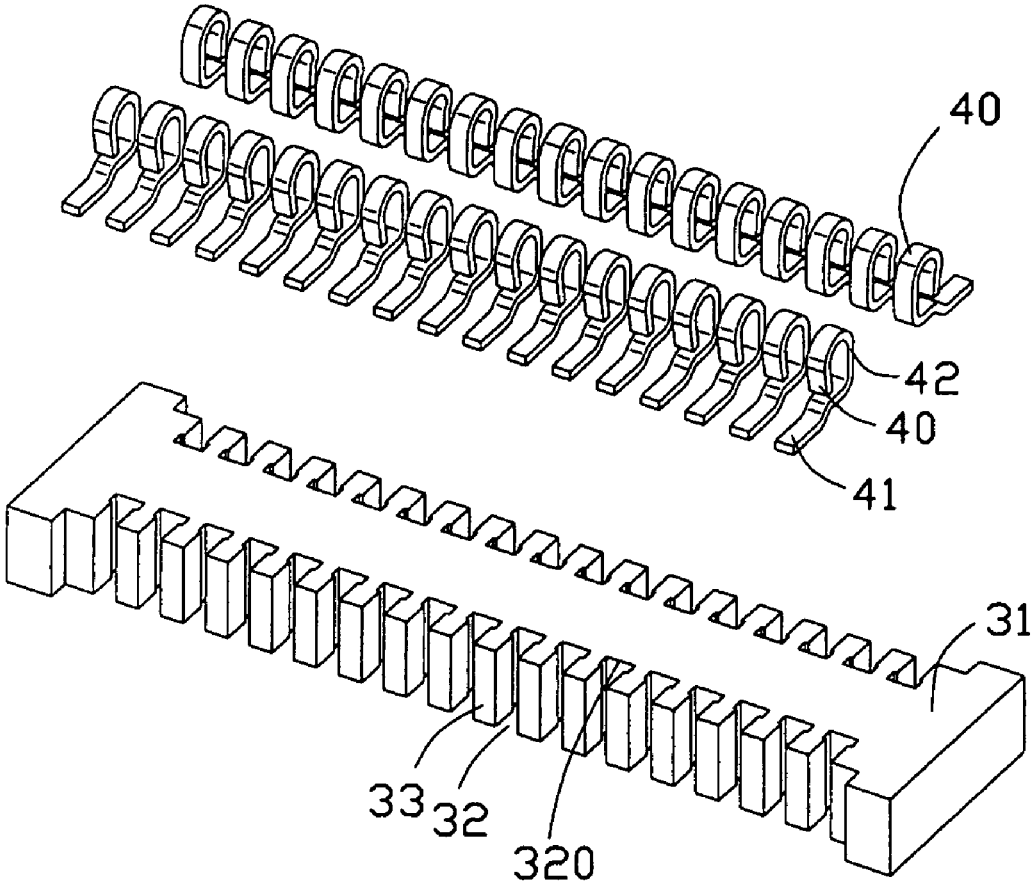
FIG. 5 is an exploded, perspective view of the plug connector in FIG. 2.

Referring to FIG. 5 and FIG. 6, the plug connector 30 comprises a plug housing 31 and a plurality of plug contacts 40, the plug housing 31 is provided with a plurality of upright passageways 32 in lateral sides thereof through the plug housing 31 in a top-to-bottom direction and a plurality of clapboard 33 between two adjacent passageways 32 in a same sides of the plug housing 31. Each passageway 32 further defines a latching slot 320 for retaining the plug contacts 40 near an inner side thereof.

The plug contact 40 is also stamped from a metal piece and comprises a tail 41 transversely extending and an inverse U-shaped second elastic portion 42 bent from an end of the tail 41 toward the other end of the tail 41. The second elastic portion 42 is upon the tail 41 and comprises a second elastic arm 43 having a second contacting portion 45 with a recess portion (not labeled) and the other leg 44 opposed the second elastic arm 43. Referring to FIG. 6, the plug contacts 40 install into the passageways 32 of the plug housing 31 from top of the plug housing 31, the legs 44 received in the latching slots 320, the second contacting portion 45 laterally extending out of the passageways 32 to exposed outside, the tails 41 extending beyond the plug housing 31 to be soldered to another pint circuit board (not shown).

Figure 8:
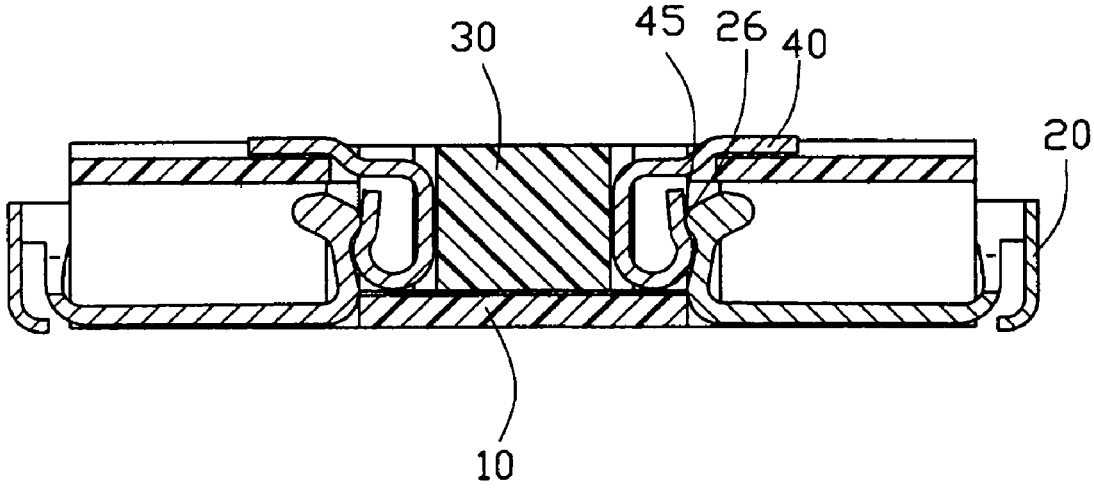
FIG. 8 is a section view of the connector assembly in accordance with the present invention when the plug connector is received in the receptacle connector.

Referring to FIG. 6 to FIG. 8, when the plug connector 30 inserts into the space 12 of the receptacle connector 10, the second elastic arms 43 of the plug contacts 40 abut against the first elastic arms 25 of the receptacle contacts 20 to get an enough pressing force on contacting points between the second contacting portions 45 and the first contacting portions 26, the tail 41 of plug contacts 40 are received between two adjacent ribs 14. The protruding portions of the first contacting portion 26 engage with the recess portion of corresponding second contacting portions 45 to lock the first contacts 20 with corresponding second contacts 40.

When the plug connector 30 is pulled from the receptacle connector 10 against the latching force between the first contacting potion 26 and the second contacting portion 45, the first contacts 20 and the second contacts 40 will be pulled, since the retaining portion 21 of the first contact 20 of the receptacle connector 10 is set along the transverse direction perspective the movement direction of the plug connector 10. Furthermore the retaining portion 21 and the elastic portion 24 of the receptacle contact 1 are in different transverse plane, that will not enhance a high of the receptacle housing 11, and may ensure the elastic portion 24 has a certain length in the transverse direction to provide a good elasticity.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. A connector comprising:

a housing defining a space in a center thereof and a transverse direction in width and having two sidewalls beside the space formed with a plurality of slots and retaining channels;

a plurality of contacts received in the housing, each contact comprising a retaining portion, an elastic portion with a contacting portion and a mounting portion, the retaining portion and the elastic portion respectively and correspondingly inserted into the retaining channel and the slot, the contacting portion exposed in the space, wherein the retaining portion and the elastic portion of each contact extend transversely in different transverse plane, and the slots and the retaining channels of the housing are alternately arranged, wherein the contact has the retaining portion, a linking portion horizontally bent from an end of the retaining portion, the mounting portion extending downwardly from an end of the linking portion and the elastic portion being in a U-shaped and linked with a part of the retaining portion near the linking portion.

2. A connector assembly comprising:

a longitudinal receptacle connector having a receptacle housing and a plurality of receptacle contacts, the receptacle housing defining a space and two lateral sidewalls with a plurality of slots and retaining channels, each receptacle contact comprising a retaining portion, a first elastic portion with a first contacting portion and a mounting portion, the retaining portions and the elastic portions respectively inserting into corresponding retaining channels and slots, the contacting portions exposed in the space;

a plug connector capable of being inserted into the space of the receptacle connector having a plug housing and a plurality of plug contacts, each plug contact having a tail and a second elastic portion with a second contacting portion for electrical contacting with the first contacting portions of the receptacle contacts, wherein the retaining portion and the first elastic portion of each receptacle contact are in different transverse plane, and the slots and the channels of the receptacle housing are alternately arranged, wherein the receptacle contact has a retaining portion, a linking portion horizontally bent from an end of the retaining portion, a mounting portion extending from the linking portion and a U-shaped elastic portion extending from a bottom edge of a part of the retaining portion near the linking portion.

3. An electrical connector assembly comprising:

a first insulative housing defining at least one slot extending along a longitudinal direction of the first housing; and at least one row of first contacts disposed in the first housing and located beside said slot, each of said first contacts including a first retention section essentially lying in a first vertical plane, and a first contact section essentially in a second vertical plane offset from said first plane in a parallel relation along said longitudinal direction; wherein the first retention sections and the first contact sections of said first contacts are staggered with each other along said longitudinal direction, wherein each of said first contacts further includes a first tail soldering section offset from the corresponding first retention section but aligned with the corresponding first contact section thereof, wherein the first tail soldering section includes a horizontal region lying in a third plane perpendicular to both said first and second vertical planes, wherein the first contact section is received within a corresponding slot in the housing, and said slot essentially extends through a bottom face of the housing, wherein the first soldering section is essentially of a J-like configuration, and said horizontal region extends forwardly thereof, further including a second insulative housing enclosing a row of second contacts, wherein each of the second contacts includes a second contact section aligned and engaged, along a lateral direction perpendicular to said longitudinal direction, with the first contact section of the corresponding first contact.

* * * * *